US011530813B2

(12) United States Patent
Meier et al.

(10) Patent No.: US 11,530,813 B2
(45) Date of Patent: Dec. 20, 2022

(54) EVAPORATOR ASSEMBLY FOR MOBILE HEATING DEVICES

(71) Applicant: WEBASTO SE, Stockdorf (DE)

(72) Inventors: Bengt Meier, Stockdorf (DE); Vitali Dell, Stockdorf (DE); Klaus Moesl, Stockdorf (DE); Andreas Rutsche, Stockdorf (DE); Thorsten Pannwitz, Stockdorf (DE); Verena Arends, Stockdorf (DE)

(73) Assignee: Webasto SE, Stockdorf (DE)

( * ) Notice: Subject to any disclaimer, the term of this patent is extended or adjusted under 35 U.S.C. 154(b) by 0 days.

(21) Appl. No.: 17/055,216

(22) PCT Filed: May 9, 2019

(86) PCT No.: PCT/EP2019/061968
§ 371 (c)(1),
(2) Date: Nov. 13, 2020

(87) PCT Pub. No.: WO2019/219510
PCT Pub. Date: Nov. 21, 2019

(65) Prior Publication Data

US 2021/0215335 A1 Jul. 15, 2021

(30) Foreign Application Priority Data

May 15, 2018 (DE) ..... 10 2018 111 636.5

(51) Int. Cl.
*F23D 3/40* (2006.01)
*F23D 3/22* (2006.01)
*F23Q 7/08* (2006.01)

(52) U.S. Cl.
CPC ..... *F23D 3/40* (2013.01); *F23D 3/22* (2013.01); *F23Q 7/08* (2013.01); *F23D 2202/00* (2013.01);
(Continued)

(58) Field of Classification Search
CPC ..... F23D 3/22; F23D 3/40; F23D 2202/00; F23D 2207/00; F23D 2213/00; F23D 2900/21002; F23Q 7/08
See application file for complete search history.

(56) References Cited

U.S. PATENT DOCUMENTS 3,531,229 A * 9/1970 Berglund ..... F23D 3/40 431/262
5,088,918 A * 2/1992 Schaale ..... F23D 3/40 431/261

(Continued)

FOREIGN PATENT DOCUMENTS

DE 1918445 A1 10/1970
DE 2129663 A1 12/1971

(Continued)

OTHER PUBLICATIONS

Machine Translation of Goetz (DE 4243712 C1) (Year: 1994).*

(Continued)

*Primary Examiner* — Alfred Basichas
(74) *Attorney, Agent, or Firm* — Quarles & Brady LLP

(57) ABSTRACT

An evaporator subassembly for mobile heating devices, in particular for a motor vehicle, having the following: an evaporator, an evaporator receptacle which is constructed to receive the evaporator, a glow plug and a combustion chamber, wherein the glow plug extends or is constructed to be extensible obliquely relative to a main surface of the evaporator into the combustion chamber.

18 Claims, 3 Drawing Sheets

(52) U.S. Cl.
CPC ..... *F23D 2207/00* (2013.01); *F23D 2213/00* (2013.01); *F23D 2900/21002* (2013.01)

(56) References Cited

U.S. PATENT DOCUMENTS

| | | | | |
|---|---|---|---|---|
| 5,722,588 | A * | 3/1998 | Inoue | B60H 1/2209 237/12.3 C |
| 6,726,114 | B2 * | 4/2004 | Blaschke | B01B 1/005 237/2 R |
| 9,395,083 | B2 * | 7/2016 | Marutani | F01N 3/2033 |
| 10,408,447 | B2 * | 9/2019 | Moesl | B60H 1/2206 |
| 2015/0102115 | A1 | 4/2015 | Collmer et al. | |
| 2017/0211813 | A1 | 7/2017 | Zoske | |

FOREIGN PATENT DOCUMENTS

| | | | | |
|---|---|---|---|---|
| DE | 3423940 | A1 | 1/1986 | |
| DE | 3726862 | A1 | 3/1988 | |
| DE | 4243712 | C1 * | 6/1994 | F23D 3/40 |
| DE | 4243712 | C1 | 6/1994 | |
| DE | 19703555 | A1 | 8/1998 | |
| DE | 10160655 | A1 | 6/2003 | |
| DE | 10249872 | A1 * | 5/2004 | F23Q 7/24 |
| DE | 19880561 | B4 | 3/2005 | |
| DE | 102014117115 | A1 | 5/2016 | |
| EP | 1342949 | A1 | 9/2003 | |
| EP | 1275901 | A2 | 10/2003 | |
| EP | 1484552 | A1 | 12/2004 | |
| RU | 2287109 | C2 | 11/2006 | |
| RU | 2572735 | C2 | 1/2016 | |

OTHER PUBLICATIONS

Machine Translation of Baade et al (DE 10249872 A1) (Year: 2004).*

Merriam-Webster Definition of "Disk-shaped" (Year: 2022).*

International Searching Authority. International Search Report and Written Opinion for application PCT/EP2019/061968, dated Sep. 6, 2019. With machine translation of International Search Report.

Federal Service for Intellectual Property, Russia, Office Action and Search Report, Application No. 2020140476/12(075318), dated Oct. 12, 2021, 16 pages.

Federal Service for Intellectual Property, Russia, Office Action, Application No. 2020140476/12 (075318), dated May 13, 2021, 14 pages.

* cited by examiner

EVAPORATOR ASSEMBLY FOR MOBILE HEATING DEVICES

CROSS-REFERENCE TO RELATED APPLICATIONS

This application represents the National Stage of International Application No. PCT/EP2019/061968, filed May 9, 2019, which claims priority to German Patent Application DE 10 2018 111 636.5, filed May 15, 2018, which disclosures are hereby incorporated by reference for all purposes.

DESCRIPTION

The disclosure relates to an evaporator subassembly for mobile heating devices and a vehicle, in particular motor vehicle, which comprises an evaporator receptacle and an evaporator.

Evaporator subassemblies are usually used in evaporator burners which are used in particular in auxiliary heaters and/or booster heaters which are operated with fluid fuel, in particular for vehicles. In such evaporator burners, liquid fuel is introduced via a fuel supply line into an evaporator. In this instance, metal nonwovens and metal grids and metal knitted fabrics may be structures used as evaporators. In particular, the structure of the evaporator used has a large number of hollow spaces so that the fluid fuel is taken up by the evaporator by a capillary action and the evaporator is permeated with fuel. So that during a start phase of the evaporator burner the fuel is evaporated out of the evaporator, heat is required and is usually provided by a glow plug.

In the previous prior art, on the one hand, comparatively complexly formed evaporators are used, as described, for example, in DE 19 18 445 A1 and in DE 21 29 663 A1. DE 19 18 445 A1 and DE 21 29 663 A1 use a sintered/porous combustion chamber cylinder which comprises two combustion chambers. DE 42 43 712 C1 also describes a pot-like material which is absorbent and heat-resistant and which consequently performs the function of an evaporator.

DE 19 880 561 B4 discloses an evaporator burner for a heating device or for a thermal regeneration of an exhaust gas particulate filter. It comprises a combustion chamber having a peripheral delimiting wall and a front delimiting wall. The front delimiting wall has a central opening, through which a central air guiding connecting piece is arranged so as to project into the combustion chamber. The air supply connecting piece has in the cylindrical connecting piece wall thereof in the combustion chamber radial air outlets in the form of longitudinal slots and a closed front wall at the end. An annular chamber, in which a porous evaporator material in the form of a multi-layered covering is provided at the combustion chamber base at the height of the front delimiting wall, is constructed by the air supply connecting piece in the combustion chamber. The multi-layered covering is supplied during operation with fuel from a lateral fuel supply. The fuel is uniformly distributed in the annular evaporator material, evaporated at the combustion chamber inner side of the evaporator material and there burnt in the annular space of the combustion chamber with air being supplied.

The above solutions of the prior art are comparatively complex to produce, whereby high costs may be produced. Furthermore, an undefined flame orientation during combustion operation may be produced in the (complexly formed) evaporators of the prior art, whereby the service-life of a corresponding evaporator burner can be greatly reduced.

For this reason, in the current prior art there are simply formed, in particular disc-like, evaporators which are received by an at least substantially pot-like evaporator receptacle, wherein a glow plug can be arranged, for example, axially, in particular coaxially, or radially relative to the evaporator receptacle.

FIG. 1A is a cross-section of an evaporator subassembly according to the prior art, wherein an at least substantially disc-like evaporator 1 is received in a pot-like evaporator receptacle 2 and a glow plug 4 is arranged coaxially relative to the evaporator receptacle 2. The term "coaxial" is intended to be understood to mean in this context that the glow plug 4 is arranged perpendicularly to a main surface 11 of the evaporator 1. The glow plug 4 is orientated by a glow plug bush 42 and securely fixed in terms of the orientation thereof. A fuel supply line 10 is arranged in FIG. 1A axially relative to the evaporator receptacle 2. In this arrangement, an additional constructive complexity has to be carried out so that a return of fluid fuel into the glow plug bush 42 is prevented.

FIG. 1B is a cross-section of an additional conventional arrangement, in which a glow plug 4 is arranged and fixed by a glow plug bush axially relative to a main surface 11 of the evaporator 1, while a fuel supply line 10 is arranged coaxially relative to the main surface 11. In this arrangement, an additional constructive complexity also has to be carried out so that a return of fluid fuel into the glow plug bush 42 is prevented. Furthermore, a uniform flow of the evaporated fuel is disrupted by the arrangement of the glow plug 4, whereby a poor combustion behaviour of this arrangement is brought about.

FIG. 1C is a cross-section of an additional arrangement of an evaporator subassembly according to the prior art. In this arrangement, a glow plug 4 is arranged radially with respect to the disc-like evaporator 1, whereby the glow plug 4 is fixed parallel with a main surface 11 of the evaporator 1. In this conventional arrangement, significant disadvantages are produced during operation of the evaporator subassembly in an evaporator burner because soot and/or coke deposits can be formed in a gap 12 which is present between the main surface 11 of the evaporator 1 and the glow plug 4 which is arranged parallel with the main surface 11. These soot and/or coke deposits lead to a thermal bridge being produced between the glow plug 4 and the evaporator 1, whereby, in particular during a start phase of an evaporator burner with an evaporator subassembly arranged in this manner, ignition energy which is introduced by the glow plug is distributed over a relatively large surface-area and the resultant energy density is thereby no longer sufficient to ignite the evaporator burner.

In the arrangements known in the prior art, significant technical disadvantages are brought about because, on the one hand, an optimum fuel transfer is dependent on the position of a fuel supply line and, on the other hand, an optimum ignition capability and optimum combustion operation are dependent on the position of a glow plug. Simultaneous optimisation of both positions is scarcely possible so that in the individual case extensive series of tests are necessary for optimising the positions. Furthermore, additional, complex, structural measures have to be taken during the coaxial and axial arrangement of the evaporator subassembly in order to prevent a portion of the fluid fuel from being able to run into the glow plug bush. A radial arrangement of a glow plug also involves disadvantages since a thermal bridge between the glow plug and evaporator can be produced with increasing operation as a result of soot and coke deposits. The thermal bridge leads during an ignition operation to an introduced ignition energy being distributed over an excessively large surface-area. An energy density resulting from this situation may no longer be sufficient to ignite the evaporator burner, whereby the evaporator burner in this state is not capable of operation and has to be cleaned and maintained in an expensive manner.

Consequently, it can be seen from the current prior art that no satisfactory technical solution is yet available for the above-described disadvantages. Therefore, an object of the disclosure is to provide an arrangement of an evaporator subassembly which, on the one hand, can be produced in a cost-effective manner and, on the other hand, allows an improvement in relation to a fuel transfer, ignition capability (during a start phase) and a uniform combustion operation.

The object is achieved in particular by an evaporator subassembly according to claim 1 and/or claim 2 and a production method according to claim 15.

According to a first aspect of the disclosure, the object is achieved in particular by an evaporator subassembly having an evaporator, an evaporator receptacle which is constructed to receive the evaporator, a glow plug and a combustion chamber, wherein the glow plug extends or is constructed to be extensible obliquely relative to a main surface of the evaporator into a combustion chamber. In this case, an amount of an angle $\alpha$ between the main surface of the evaporator and the glow plug particularly has a value between 0° and 90° (without 0° and 90°), preferably a value between 5° and 70°, or in particular a value between 7° and 50°, or more preferably a value between 9° and 30°. As a result of the oblique position, it is possible to provide an arrangement in which a comparatively good ignition capability is (permanently) maintained, wherein in particular a comparatively good fuel transfer is also achieved. Furthermore, in particular a uniform combustion operation is also allowed. Preferably, the glow plug is directed away from the evaporator (extending obliquely). In particular, a distal end of the glow plug is further away from the evaporator or from the main member thereof than a proximal end (or than a portion of the glow plug at the location of the introduction thereof into a/the combustion chamber). Alternatively, a proximal end (or a portion of the glow plug at the location of the introduction thereof into a/the combustion chamber) of the glow plug can also be further away from the evaporator or from the main member thereof than a distal end.

According to a second aspect of the disclosure, which can be combined in particular with the first aspect of the disclosure, the object is achieved by an evaporator subassembly having an evaporator, an evaporator receptacle which is constructed to receive the evaporator and a glow plug, wherein at least one central projection projects from a main surface of the evaporator (into a/the combustion chamber). As a result of the projection which is arranged in this manner, it is further allowed that the evaporator subassembly can be operated with fuels which boil only at high temperatures, such as, for example, diesel fuel. As a result of the projection of the evaporator, an additional volume which acts as an additional fuel reservoir and in which additional fuel which has yet to be evaporated can be received is formed. The additional fuel reservoir has a particularly advantageous effect on a starting or ignition behaviour of an evaporator burner which is operated with fuels which boil only at very high temperatures, such as, for example, B7 and B100.

The term "main surface of the evaporator" is in particular intended to be understood to mean a (free) surface of a main member of the evaporator. The main surface is preferably at least substantially planar (where applicable with uneven portions which correspond at a maximum to 0.2 times a thickness of the main member) and/or defines at least 10%, preferably 20%, more preferably at least 50% of an inner surface (which comes into contact with the gas in a/the combustion chamber) of the evaporator. The term "main member" is in particular intended to be understood to be the (entire) evaporator without any projection(s). The main member may have an at least substantially constant thickness and/or be constructed to be disc-like (for example, with a circular outline) and/or plate-like (for example, with a polygonal, in particular rectangular outline). The evaporator or the main member thereof may be constructed where applicable without openings which exceed a diameter of 100 mm or 10 mm or 1 mm. The evaporator is particularly not constructed in an annular manner. The evaporator or the main member thereof or the main surface thereof can at least partially (where applicable completely) be arranged in a/the combustion chamber.

A free spatial portion is preferably located between the evaporator and at least one portion of the glow plug which projects into the combustion chamber (that is to say, not a spatially separating structure, such as, for example, a partition wall or a portion thereof). Preferably, only gas (during operation) is located in a region which is between the evaporator or (at least) a portion of the evaporator which projects into the combustion chamber and the glow plug.

The term "central projection" is in particular intended to be understood to be a projection which is spaced apart by at least 5% of the (maximum) diameter thereof in a radial direction from an edge of the main surface and/or which has at least a portion which is located at a geometric centre or which is at least no further than 50%, preferably 25% of an extent away from the geometric centre relative to the edge of the main surface of the geometric centre. Preferably, an outline of the projection is point-symmetrical.

The evaporator may be an independent component with respect to the evaporator receptacle, in particular inserted therein, where applicable in a non-positive-locking manner or pressed therein. In embodiments, the evaporator may be retained in a positive-locking manner by a retention device, for example, comprising at least one retention ring and/or at least one retention projection. Alternatively or additionally, the evaporator may be secured in a materially engaging manner.

The evaporator receptacle may be constructed in a pot-like manner. According to the explanations, the evaporator receptacle is not constructed in an annular manner or not as a torus. The evaporator receptacle may form an independent component with respect to a combustion chamber wall or be constructed at least partially by a combustion chamber wall.

In a preferred embodiment of the disclosure, a one-stage, two-stage or multi-stage evaporator dome is provided in the evaporator subassembly between the evaporator receptacle and a fuel supply line. The efficiency of the evaporator can thereby be further improved. For example, an improved heating power range can be achieved by using an evaporator dome. In this case, a shape of the evaporator dome can be adapted to the shape of the evaporator in a suitable manner.

The term "evaporator dome" is in particular intended to be understood to be a projection which may be constructed, for example, in a cylindrical, conical, cupola-like or quadrilateral manner. A one-stage or two-stage evaporator dome particularly comprises two or more projections which preferably follow each other in a cascading or step-like manner. There are received inside the one, two or multi-stage evaporator dome in particular one, two or more evaporator structures which preferably have a different porosity and/or a different shape. Furthermore, the one, two or multi-stage evaporator dome (generally or with respect to the individual stage) and/or the evaporator receptacle can preferably be constructed monolithically.

In particular, the glow plug is received in the evaporator receptacle via a glow plug bush, wherein the glow plug is preferably fixed in the glow plug bush by a retention element, in particular comprising a or in the form of a bent plate member and/or comprising a or in the form of an engagement. The retention element may have a thread and/or a press-fit. As a result of a glow plug bush which is integrated in the evaporator receptacle, a simple replacement of the glow plug is allowed, whereby a rapid and simple maintenance of the glow plug is possible and a defective glow plug, for example, can be replaced directly and rapidly.

Preferably, a cross-sectional profile of the projection of the evaporator may be constructed to be polygonal, in particular quadrilateral, preferably rectangular or trapezoidal, with where applicable rounded corners. Such a projection may be produced in a comparatively cost-effective manner.

In particular, the projection of the evaporator is constructed at least substantially as a ring which preferably falls away in a shallow manner in a radial direction of the evaporator receptacle, whereby the shape of the projection can advantageously be adapted to the requirements of an evaporator burner, in which the evaporator is used. By accordingly selecting the shape of the projection, a formation of a first pilot flame during a start operation can be promoted. In this case, fuel can be conveyed by the fuel reservoir to an ignition source, for example, a glow plug, and retained there. Heat, which heats and evaporates the remaining fuel, can be released by the pilot flame which is formed at the ignition source. Furthermore, hot flue gases which are retained by the pilot flame in so-called dead zones can be prevented so that the hot flue gases are directly conveyed out of the combustion chamber by an air flow. Furthermore, a present quantity of fluid fuel which can also act as thermal ballast and which can thus have negative influences on the combustion properties is reduced by the shape which flattens in a radial direction, as, for example, in the case of a trapezoidal shape.

Preferably, the evaporator is at least partially produced from a porous nonwoven and/or grid and/or knitted fabric and/or interlaced fabric and/or web, in particular metal (fibre) nonwoven and/or metal grid and/or metal knitted fabric and/or interlaced metal fabric and/or metal mesh and/or at least partially from a (another) textile moulded fibre member, whereby the production costs can be reduced. Alternatively or additionally to metal, other (heat-resistant) materials, such as, for example, plastics material and/or ceramic material, can also be used. In particular, the evaporator can be at least partially produced from a porous heat-resistant metal, preferably at least partially from steel, in particular a high-grade steel alloy (for example, 1.4841 or 1.4767).

In a preferred embodiment, a flame detector which preferably forms an integral component with the glow plug is provided. Particularly in this instance, in a particularly simple embodiment, the resistance of the glow plug which changes with the temperature is measured. Via the detected resistance value, conclusions can be drawn regarding the temperature within the combustion chamber, with particular regard to the extent to which a flaming combustion is taking place. By integrating the glow plug and the flame detector in a component, functionalities of both components are produced in one component in a compact manner, whereby a further improvement of the arrangement of a separate flame detector can be achieved within the evaporator subassembly.

Preferably, the projection is an integral component of the evaporator, whereby the costs of the production can be further reduced.

Preferably, the evaporator receptacle has at least one combustion air perforation. It is thereby possible to ensure an advantageous combustion air supply or to achieve a construction type which is as compact as possible for the evaporator subassembly.

The fuel supply line may be arranged centrally (in particular, as defined above in connection with the projection) with respect to the (or centrally in the) evaporator receptacle.

The above-mentioned object is further achieved in particular by a vehicle, preferably a motor vehicle, comprising an evaporator subassembly of the above type.

The above object is further achieved by the use of an evaporator subassembly of the above type for a vehicle, in particular a motor vehicle (for example, car or lorry).

The above-mentioned object is further achieved by a method for producing an evaporator subassembly, in particular of the above type, comprising the following steps: forming the evaporator receptacle, providing the evaporator and receiving the evaporator in the evaporator receptacle. Preferably, the projection is produced in one step with the evaporator, in particular by pressing a basic material into a negative mould. It is thereby possible to produce the evaporator in a particularly cost-effective manner. Alternatively, it is also possible to connect the projection preferably in a materially engaging manner to the evaporator, in particular by means of sintering or welding. Additional method steps will be appreciated in particular from the above description of the evaporator subassembly.

The above object is further achieved in particular by a set for producing an evaporator subassembly, in particular of the above type, comprising an evaporator receptacle and at least two different evaporators which can be received selectively in the evaporator receptacle and which are constructed differently. Preferably, a first evaporator has at least a first projection (preferably in principle as described above) and the second evaporator has at least one different/other projection (preferably in principle as described above) or no projection. It is particularly thereby possible for an evaporator subassembly for high-boiling fuels, such as diesel fuel, to differ simply as a result of the projection of the evaporator from an evaporator subassembly for low-boiling fuels, such as, for example, petroleum fuels.

Generally, as a result of a modular construction of the evaporator subassembly, it is readily possible to produce evaporator subassemblies for different fuels, in particular for diesel fuels and for petroleum fuels, in the same production installation and consequently to further reduce the production costs.

Preferably, a diameter of the evaporator (in a radial direction) is at least 10 mm, preferably at least 20 mm and/or a maximum of 80 mm, preferably a maximum of 50 mm. A thickness of the evaporator (in an axial direction; where applicable, without any projection) may be at least 0.7 mm, preferably at least 1.5 mm and/or a maximum of 5 mm, preferably a maximum of 4 mm. A diameter of the projection may be at least 5 mm, preferably at least 8 mm and/or a maximum of 30 mm, preferably a maximum of 25 mm. A height of the projection (in an axial direction) may be at least 2 mm, preferably at least 4 mm and/or a maximum of 15 mm, preferably a maximum of 8 mm. A ratio between a/the thickness of the evaporator (without any projection) to a/the height of the projection may be at least 0.1, preferably at least 0.3, and/or a maximum of 3, preferably a maximum of 1, more preferably a maximum of 0.5. Preferably, the projection may be constructed as a ring, wherein an outer diameter of the ring is at least 8 mm, preferably at least 16 mm and/or a maximum of 40 mm, preferably a maximum of 25 mm and/or an inner diameter of the ring is at least 3 mm, preferably at least 5 mm and/or a maximum of 15 mm, preferably a maximum of 12 mm. Where applicable, the evaporator can be constructed as a cone, wherein a core of the cone may have a diameter of at least 5 mm, preferably at least 12 mm and/or a maximum of 30 mm, preferably a maximum of 18 mm, and/or an outer diameter of a flattened portion of the cone may be at least 10 mm, preferably at least 20 mm and/or a maximum of 40 mm, preferably a maximum of 40 mm.

Additional embodiments will be appreciated from the dependent claims.

The disclosure is described below with reference to embodiments which are explained in greater detail with reference to the illustrations. In the drawings.

Figure 1A:
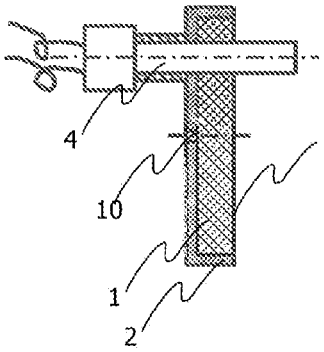
Fig. 1A (Prior Art)
FIG. 1A is a cross-section of an evaporator subassembly for a mobile heating device, as may be found in the prior art.
Figure 1B:
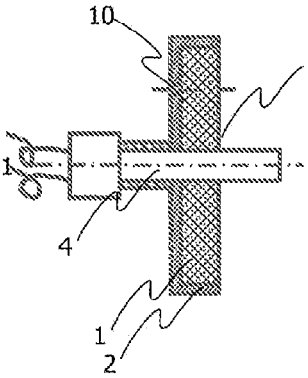
Fig. 1B (Prior Art)
FIG. 1B is a cross-section of an evaporator subassembly for a mobile heating device according to another embodiment of the prior art.
Figure 1C:
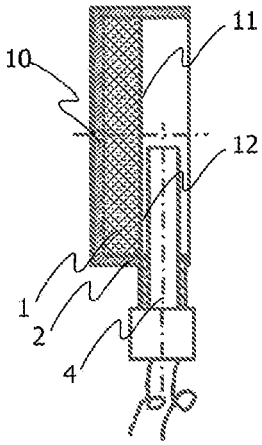
Fig. 1C (Prior Art)
FIG. 1C is a cross-section of an evaporator subassembly for a mobile heating device, as generally used in the prior art.
Figure 2:
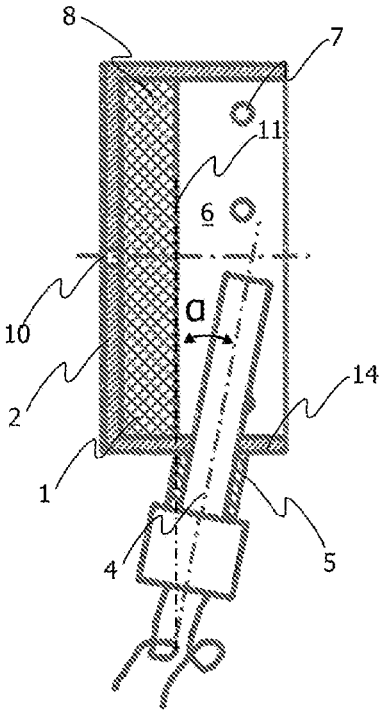
FIG. 2 is a cross-section of a first embodiment of the evaporator subassembly according to the disclosure.

FIG. 2 is a cross-section of a first embodiment of the evaporator subassembly according to the disclosure. The evaporator subassembly comprises an evaporator receptacle 2 in which an evaporator 1 is received. The evaporator receptacle 2 opens in a combustion chamber 6. A fuel supply line 10, through which fuel reaches the evaporator 1 and the fuel in the evaporator is dispersed and vaporised out of the evaporator 1 in the direction of the combustion chamber 6, opens centrally in the evaporator receptacle 2.

Furthermore, a plurality of combustion air perforations 7 are constructed in a side wall 14 of the evaporator receptacle 2, through which combustion air can reach the combustion chamber 6 and can mix with the evaporated fuel. It would also be similarly possible (cf. FIG. 4) for the combustion air perforations 7 to be constructed in a side wall (other side wall or additional side wall with respect to the evaporator receptacle) of the combustion chamber 6.

A glow plug bush 5 is arranged in an additional portion of the side wall 14, wherein it defines an angle $\alpha$ of the glow plug 4 with respect to a main surface 11 of the evaporator 1. The main surface 11 is a (free) surface of a main member 8 of the evaporator 1. The main member 8 is formed by the (entire) evaporator 1 (where applicable without any projection 9, if present, cf. FIG. 4). In FIG. 2, the evaporator 1 does not have any projection 9 and has at least substantially a constant thickness or is constructed to be disc-like (for example, with a circular outline).

It would also be conceivable for the glow plug bush 5 to be constructed on another side wall of the combustion chamber 6. A glow plug 4 is received in the glow plug bush 5, wherein the glow plug is fixed by a retention element (not illustrated). Furthermore, a flame detector (not illustrated) can be integrated in the glow plug 4 so that the glow plug can provide an additional functionality of flame monitoring.

Figure 3:
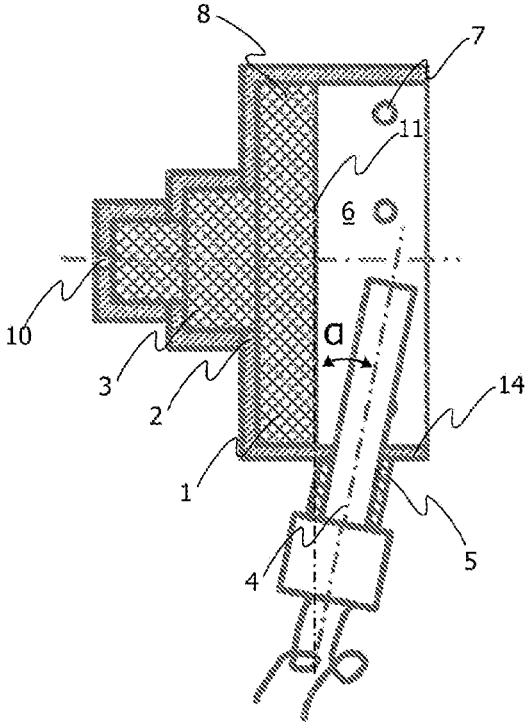
FIG. 3 is a cross-section of a second embodiment of the evaporator subassembly according to the disclosure.

FIG. 3 is a cross-section of a second embodiment of the evaporator subassembly according to the disclosure in which in addition to the embodiment illustrated in FIG. 2 a two-stage evaporator dome 3 is integrated in the evaporator receptacle 2 between the fuel supply line 10 and the evaporator 1.

Figure 4:
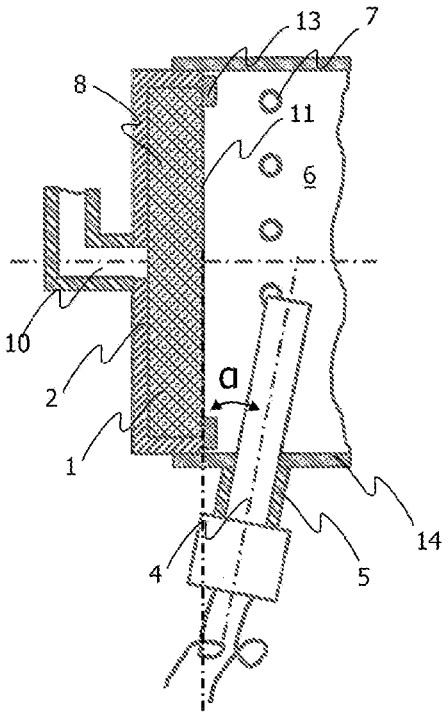
FIG. 4 is a cross-section of an additional embodiment of the evaporator subassembly according to the disclosure.

FIG. 4 is a cross-section of an additional embodiment of the disclosure, in which the combustion chamber 6 is delimited by a side wall 14 of the combustion chamber 6 which is separate from the evaporator receptacle. In addition to the embodiment which is illustrated in FIG. 2, a retention device 13 is arranged at the outer edge of the evaporator receptacle 2 and is constructed in this embodiment as a retention ring. The evaporator 1 is fixed in its position by the retention device 13.

Figure 5:
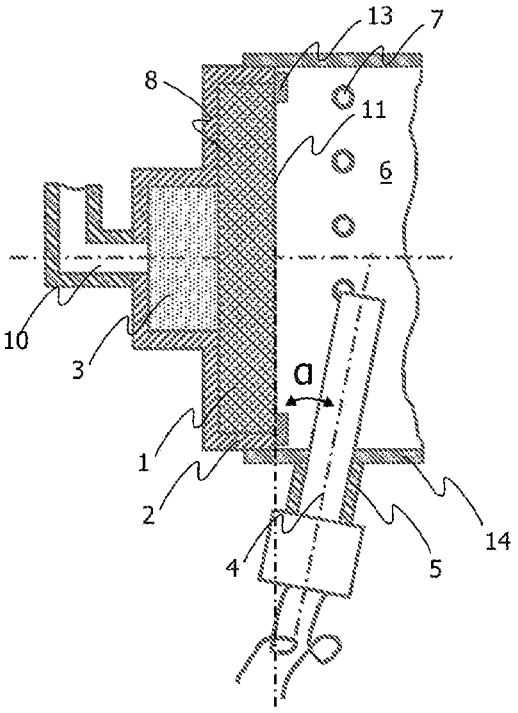
FIG. 5 is a side view of an additional embodiment of the evaporator subassembly according to the disclosure.

FIG. 5 is a cross-section of an additional embodiment. In this embodiment, in addition to the embodiment from FIG. 4, a one-stage evaporator dome 3 is arranged between the evaporator receptacle 2 and a fuel supply line 10.

Figure 6:
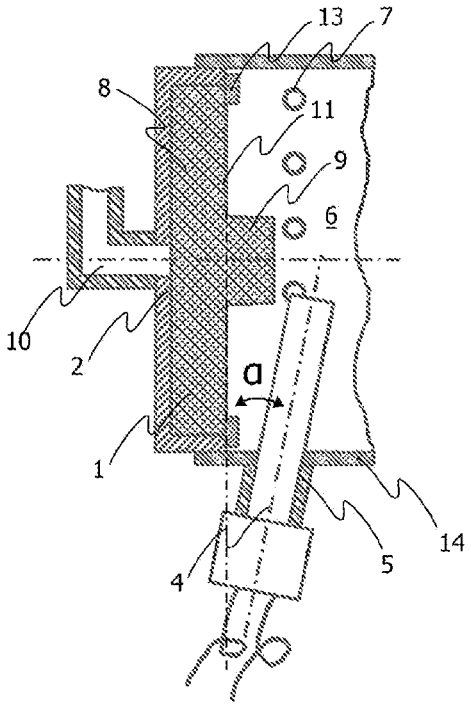
FIG. 6 is a side view of an additional embodiment of the evaporator subassembly according to the disclosure.

FIG. 6 is a cross-section of an additional embodiment of the evaporator subassembly according to the disclosure. In this case, the evaporator 1 has a central projection 9 which projects out of the evaporator 1 in the direction of the combustion chamber 6 and which thus reduces a spacing between the evaporator 1 and the glow plug 4. The projection 9 of the evaporator 1 is in this embodiment a cylinder (illustrated as a rectangle in the cross-section).

Figure 7:
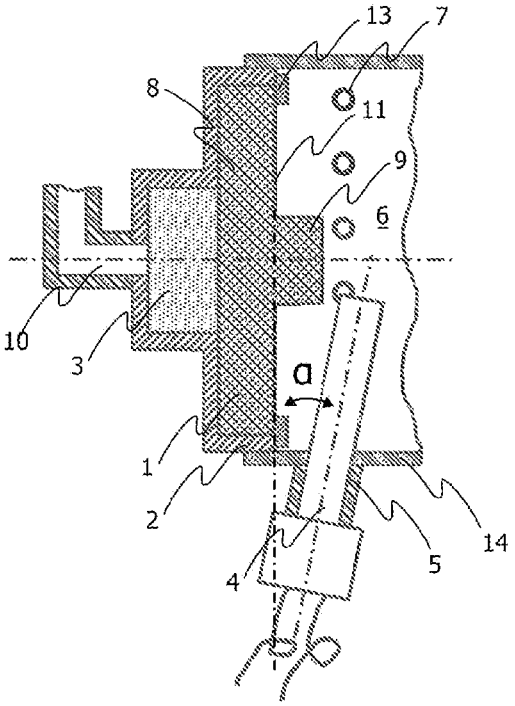
FIG. 7 is a side view of an additional embodiment of the evaporator subassembly according to the disclosure.

FIG. 7 is a cross-section of an additional embodiment of the evaporator subassembly according to the disclosure in which, in addition to the embodiment illustrated in FIG. 6, an evaporator dome 3 is integrated in the evaporator receptacle 2 between the fuel supply line 10 and the evaporator 1. Preferably, a multi-stage evaporator dome 3 is integrated in the evaporator receptacle 2 (not illustrated).

Figure 8:
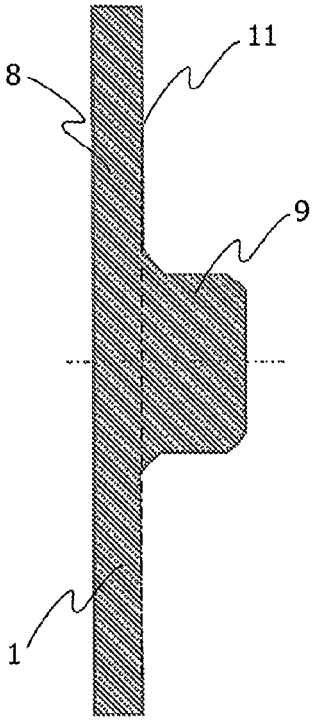
FIG. 8 is a cross-section of an embodiment of the evaporator according to the disclosure.

FIG. 8 is a cross-section of an embodiment of the evaporator 1 according to the disclosure. In this embodiment, the projection 9 is substantially formed by a cylinder.

Figure 9:
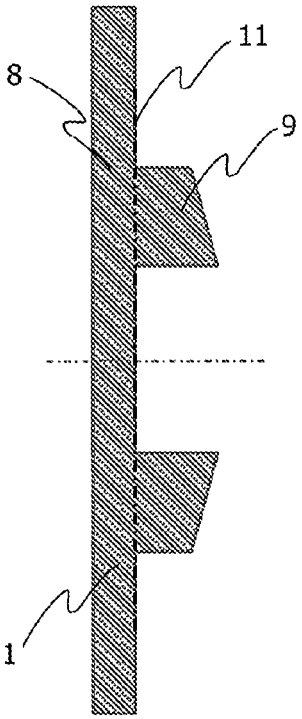
FIG. 9 is a cross-section of an additional embodiment of the evaporator according to the disclosure.

FIG. 9 is a cross-section of an additional embodiment of the evaporator 1 according to the disclosure. In this embodiment, a ring (torus) forms the projection 9. An upper side of the ring which projects into the combustion chamber 6 is flattened in a radial direction in this case, whereby two trapeziums which each have a side which is flattened in an axial direction can be seen in the cross-sectional view.

Figure 10:
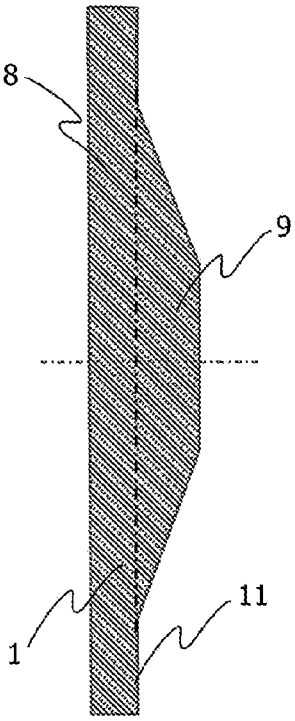
FIG. 10 is a cross-section of an embodiment of the evaporator according to the disclosure.

FIG. 10 is a cross-section of an additional embodiment of the evaporator 1 according to the disclosure. In this embodiment, a cone forms the projection 9 of the evaporator 1. The projection 9 is illustrated as a trapezium in the cross-sectional view in FIG. 10.

At this point, it may be noted that all the above-described components are claimed alone per se and in any combination, in particular the details illustrated in the drawings, as being inventively significant. Modifications thereto are commonplace to the person skilled in the art.

LIST OF REFERENCE NUMERALS

1 Evaporator
2 Evaporator receptacle
3 Evaporator dome
4 Glow plug/flame detector
5 Glow plug bush
6 Combustion chamber
7 Combustion air perforation
8 Main member
9 Projection
10 Fuel supply line
11 Main surface of the evaporator
12 Gap
13 Retention device
14 Side wall
α Angle

The invention claimed is:

1. An evaporator subassembly for mobile heating devices, in particular for a motor vehicle, having the following:

an evaporator;

an evaporator receptacle which is constructed to receive the evaporator, wherein a main member of the evaporator is disc-shaped and/or plate-shaped;

a glow plug and a combustion chamber, wherein at least a portion of the glow plug extends or is constructed to be extensible into the combustion chamber angled obliquely relative to a main surface of the evaporator and at a position offset from the main surface of the evaporator main surface, wherein a free spatial portion is located between the main surface of the evaporator and the at least a portion of the glow plug in the combustion chamber.

2. The evaporator subassembly according to claim 1, wherein at least one central projection projects from a main surface of the evaporator.

3. The evaporator subassembly according to claim 2, wherein a cross-sectional profile of the projection of the evaporator is constructed to be polygonal.

4. The evaporator subassembly according to according to claim 2, wherein the projection of the evaporator is constructed as a ring.

5. The evaporator subassembly according to according to claim 2, wherein the projection is an integral component of the evaporator.

6. The evaporator subassembly according to claim 1 wherein a one-stage, two-stage or multi-stage evaporator dome is provided between the evaporator receptacle and a fuel supply line.

7. The evaporator subassembly according to claim 1, wherein the glow plug is received in the evaporator receptacle via a glow plug bush.

8. Evaporator subassembly according to claim 7, wherein the glow plug is fixed in the glow plug bush by a bent plate member, and/or a thread and/or a press-fit.

9. The evaporator subassembly according to claim 1, wherein the evaporator comprises a porous nonwoven material, and/or a textile moulded fibre member, and/or a porous heat-resistant metal.

10. The evaporator subassembly according to claim 1, further comprising a flame detector which forms an integral component with the glow plug.

11. The evaporator subassembly according to claim 1, wherein the evaporator receptacle has at least one combustion air perforation.

12. A motor vehicle, comprising an evaporator subassembly according claim 1.

13. Method for producing an evaporator subassembly according to claim 1, comprising the following steps:

forming the evaporator receptacle;

providing the evaporator; and receiving the evaporator in the evaporator receptacle.

14. Method for production according to claim 13, wherein a projection is formed extending from a main surface of the evaporator in one step with the evaporator by pressing a basic material into a negative mould, or is fitted to the evaporator by sintering or welding.

15. A kit for producing an evaporator subassembly according to claim 1 comprising an evaporator receptacle and at least two different evaporators which can be received selectively in the evaporator receptacle and which are constructed differently.

16. The evaporator subassembly according to claim 1, wherein the evaporator comprises a nonwoven metal fiber.

17. The evaporator subassembly according to claim 1, wherein the evaporator comprises steel.

18. The evaporator subassembly according to claim 1, wherein the glow plug extends into the combustion chamber through a side wall of the evaporator receptacle.

* * * * *